US010245205B2

(12) United States Patent
Miles

(10) Patent No.: US 10,245,205 B2
(45) Date of Patent: Apr. 2, 2019

(54) SCRATCHING IMPLEMENT

(71) Applicant: Mallika Miles, Saint John (CA)

(72) Inventor: Mallika Miles, Saint John (CA)

( * ) Notice: Subject to any disclaimer, the term of this patent is extended or adjusted under 35 U.S.C. 154(b) by 456 days.

(21) Appl. No.: 14/842,057

(22) Filed: Sep. 1, 2015

(65) Prior Publication Data

US 2017/0056278 A1 Mar. 2, 2017

(51) Int. Cl.
*A61H 7/00* (2006.01)
*A61H 19/00* (2006.01)

(52) U.S. Cl.
CPC ..... *A61H 7/003* (2013.01); *A61H 2201/0157* (2013.01); *A61H 2201/0161* (2013.01); *A61H 2201/1253* (2013.01); *A61H 2201/1635* (2013.01); *A61H 2205/021* (2013.01)

(58) Field of Classification Search
CPC ..... A61H 7/003; A61H 2201/1253; A61H 2201/0161; A61H 2201/1635; A61H 2201/0157; A61H 2205/021; A61H 15/0085; A61H 15/0092
USPC ..... 601/134, 135
See application file for complete search history.

(56) References Cited

U.S. PATENT DOCUMENTS 547,843 A * 10/1895 Burkhardt ..... A42B 7/00 132/61
1,629,967 A * 5/1927 Rex ..... A45D 29/17 132/75.3
2,181,448 A * 11/1939 Behr ..... A45D 24/18 132/120
3,768,463 A 10/1973 Curry
4,343,321 A * 8/1982 Caranicas ..... A45D 6/14 132/276
5,382,222 A * 1/1995 Yih-Jong ..... A61H 7/003 601/135
5,655,257 A 8/1997 Chavez
D447,279 S * 8/2001 Altobellis ..... D28/7
8,997,756 B2 * 4/2015 Haynes ..... A45D 24/02 132/114
2004/0134509 A1 7/2004 Belton
2006/0184078 A1 * 8/2006 Robertson ..... A61H 7/003 601/137
2011/0094265 A1 * 4/2011 Dost ..... A44C 25/004 63/1.14
2013/0056932 A1 * 3/2013 McLaughlin ..... A63F 3/02 273/260

(Continued)

*Primary Examiner* — Megan Anderson
(74) *Attorney, Agent, or Firm* — Global Intellectual Property Agency, LLC; Daniel Boudwin

(57) ABSTRACT

A scratching implement to allow a user to scratch his or her scalp without disturbing or interfering with his or her hairstyle. The scratching implement includes an elongated shaft having a first end and a second end, wherein the second end provides a scratching end. The first end includes a transversely affixed crossbar in relation to the elongated shaft to provide a handle. The first end further includes a circular ring affixed thereto configured to allow the user to carry the scratching implement on a keychain. The scratching implement includes a cover having an indentation thereon configured to receive and removably secure the elongated shaft via friction fit. An alternative embodiment includes a hinge or joint along a substantial midpoint of the elongated shaft to allow the implement to be folded for storage.

10 Claims, 3 Drawing Sheets

(56) References Cited

U.S. PATENT DOCUMENTS

| | | | | |
|---|---|---|---|---|
| 2013/0079691 | A1* | 3/2013 | Huxable | A61H 7/003 601/136 |
| 2013/0276806 | A1 | 10/2013 | Haynes | |
| 2015/0366744 | A1* | 12/2015 | Rivers | A61H 7/005 601/136 |
| 2016/0346159 | A1* | 12/2016 | Dixon | A61H 7/003 |
| 2017/0119617 | A1* | 5/2017 | Bargowski | A61H 7/003 |

* cited by examiner

SCRATCHING IMPLEMENT

FIELD OF THE INVENTION

The present invention relates to scalp scratching devices. More particularly, the present invention provides a scratching implement that allows a user to scratch his or her scalp without interfering with or disturbing the style of his or her hair. The scratching implement includes an elongated shaft having a first end and a second end, wherein the second end provides a scratching end. The first end includes a handle and may further include a circular ring configured to allow the scratching implement to be carried on a keychain.

BACKGROUND OF THE INVENTION

It is often difficult for a person to scratch his or her scalp without disturbing his or her hairstyle. This is particularly true for people having braided hair and those who have a weave. An itchy scalp is particularly troublesome for braided hair or weaved hair because scratching hair carelessly may result in ruined braids or weaves. Many people often pat their weaves or braids to alleviate the itches. However, often the patting motion is not enough to provide relief for itchy scalps.

In addition, people who style their hair in weaves or braids often take preventive measures to avoid an itchy scalp. These include cautiously braiding hair so that the foundation of their hair is not pulled too tight. Hair that is pulled too tightly during braiding can cause inflammation of the skin on the scalp leading to an itchy scalp. Another preventive measure is to wash their braided or weaved hair and ensure that the foundation is fully dried after doing so. Damp braids and weaves often can provide the proper environment for growth of bacteria and mold, which can also cause itching. Despite these countermeasures, some people often still need a device that allows them to alleviate an itching scalp without ruining their braids or weave.

Devices have been disclosed in the prior art that relate to scalp scratching devices with various head engaging means. These include devices that have been patented and published in patent application publications. Some of these devices provide scrubbing devices having a circular shape and that are securable to the perimeter of a hair piece on the user's scalp beneath the hair piece. Other devices provide a scalp scratching device having a handle and a prong that can be used to scratch the user's scalp. These devices, however, fail to provide an elongated shaft having a circular ring on an end thereof adapted to be secured to a set of keys or other similar items.

It is therefore submitted that the present invention is substantially divergent in design elements from the prior art, and consequently it is clear that there is a need in the art for an improvement to scratching implements. In this regard, the instant invention substantially fulfills these needs.

SUMMARY OF THE INVENTION

In view of the foregoing disadvantages inherent in the known types of scratching implements now present in the prior art, the present invention provides a scratching implement, wherein the same can be utilized for allowing a user to scratch an itch on his or her scalp without interfering with the user's hairstyle.

It is therefore an object of the invention to provide a new and improved scratching implement that has all of the advantages of the prior art and none of the disadvantages.

Another object of the present invention is to provide a new and improved scratching implement comprising an elongated shaft having a first end and a second end, wherein the first end includes a crossbar that is transversely affixed in relation to the elongated shaft and configured to provide a handle for a user to use the second end of the elongated shaft on his scalp.

Yet another object of the present invention is to provide a new and improved scratching implement, wherein the second end is pointed or substantially pointed to provide a scratching end for a user.

Still yet another object of the present invention is to provide a new and improved scratching implement, wherein the first end further includes a circular ring, which allows the user to attach the implement to a keychain.

Yet a further object of the present invention is to provide a new and improved scratching implement having a cover with an indentation thereon configured to receive and removably secure the elongated shaft via a frictional fit.

An additional object of the present invention is to provide a new and improved scratching implement, wherein an alternative embodiment includes a joint at a substantial midpoint of the elongated shaft, thereby allowing the second end, i.e., the scratching end to actuate towards and away from the first end on a singular plane.

Still yet another object of the present invention is to provide a new and improved scratching implement wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
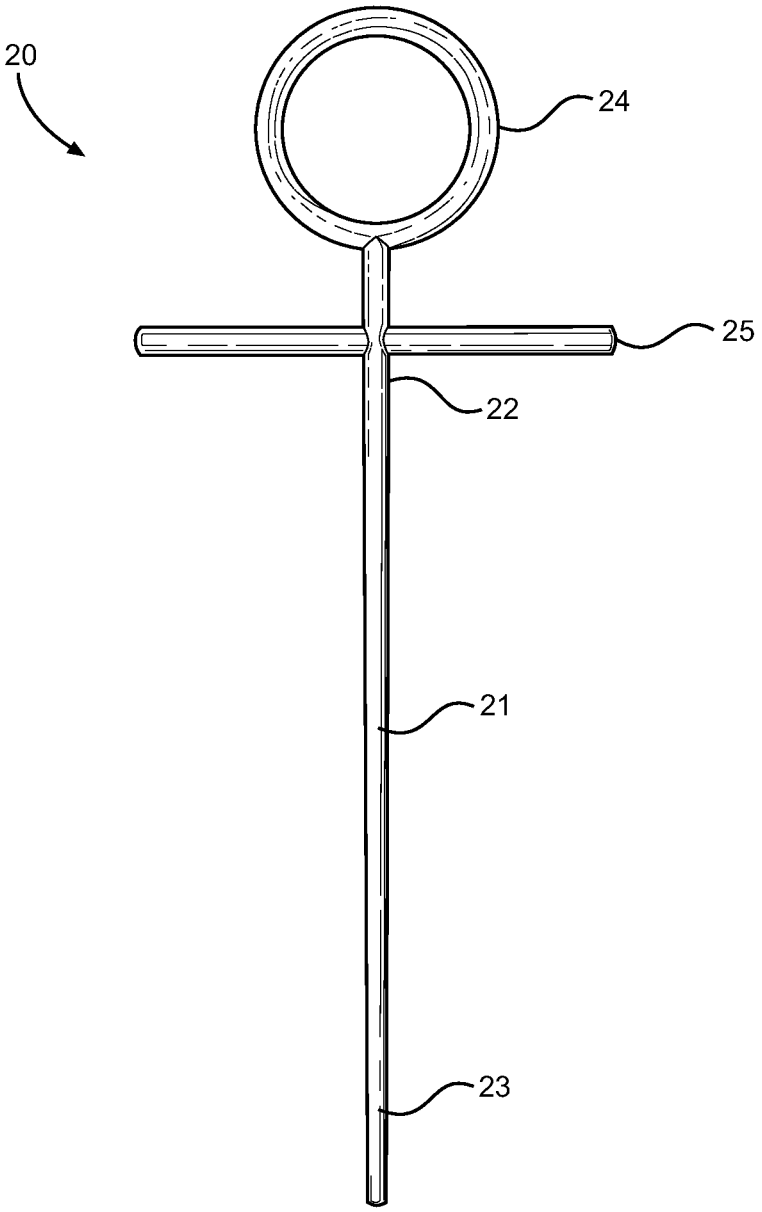
FIG. 1 shows an overhead perspective of the present invention.

Reference is made herein to the attached drawings. Like reference numerals are used throughout the drawings to depict like or similar elements of the scratching implement. For the purposes of presenting a brief and clear description of the present invention, the preferred embodiment will be discussed as used for allowing a user to scratch his or her scalp without ruining his or her braids or weave. The figures are intended for representative purposes only and should not be considered to be limiting in any respect.

Referring now to FIG. 1, there is shown an overhead perspective of the scratching implement. The scratching implement 20 is configured to allow a user to scratch his or her scalp without interfering with or disturbing the user's hairstyle. The scratching implement 20 is particularly advantageous as it provides a tool for relieving a user's itch without ruining their braids or weave. The scratching implement 20 comprises an elongated shaft 21 having a first end 22 and a second end 23. The elongated shaft 21 is preferably linear in configuration. The elongated shaft 21 is shown as having a substantially cylindrical configuration, however, in alternate embodiments the elongated shaft 21 comprises shaft configurations, such as a rectangular rod.

The second end 23 is adapted for use in scratching the user's head. In some embodiments, the second end 23 is pointed or substantially pointed to allow for the second end 23 to be the scratching end that relieves an itch on the user's scalp. In other embodiments, the second end 23 is rounded so that it does not have any sharp points or edges that may accidentally scrape or harm the user.

The first end 22 comprises a handle 25 thereon that allows the user to easily hold and manipulate the scratching implement 20. The handle 25 helps the user to direct the scratching implement 20 to the desired area and helps to prevent the user from dropping the implement while using the same. In the illustrated embodiment, the handle 25 includes a crossbar that is affixed transversely in relation to the elongated shaft 21. However, in alternate embodiments, the handle 25 is provided in any of various other configurations.

In some embodiments, the first end 22 comprises a ring 24 that allows the scratching implement 20 to be secured to a keychain or other support. The ring 24 is preferably circular in configuration. The ring 24 is integrally formed with the elongated shaft 21. In an alternative embodiment, the first end 22 includes a keyring. The keyring includes a single piece of metal wrapped in a double loop to allow either end of the loop to be pried open. In this manner, the user is able to insert a key and slide along the spiral of the double loop until the key is wholly engaged onto the ring. It is anticipated that those of ordinary skill in the art will readily envision other shapes and forms of the ring to achieve the function and advantages described herein. These modifications, variations, and alterations are deemed within the scope and spirit of this invention.

Figure 2:
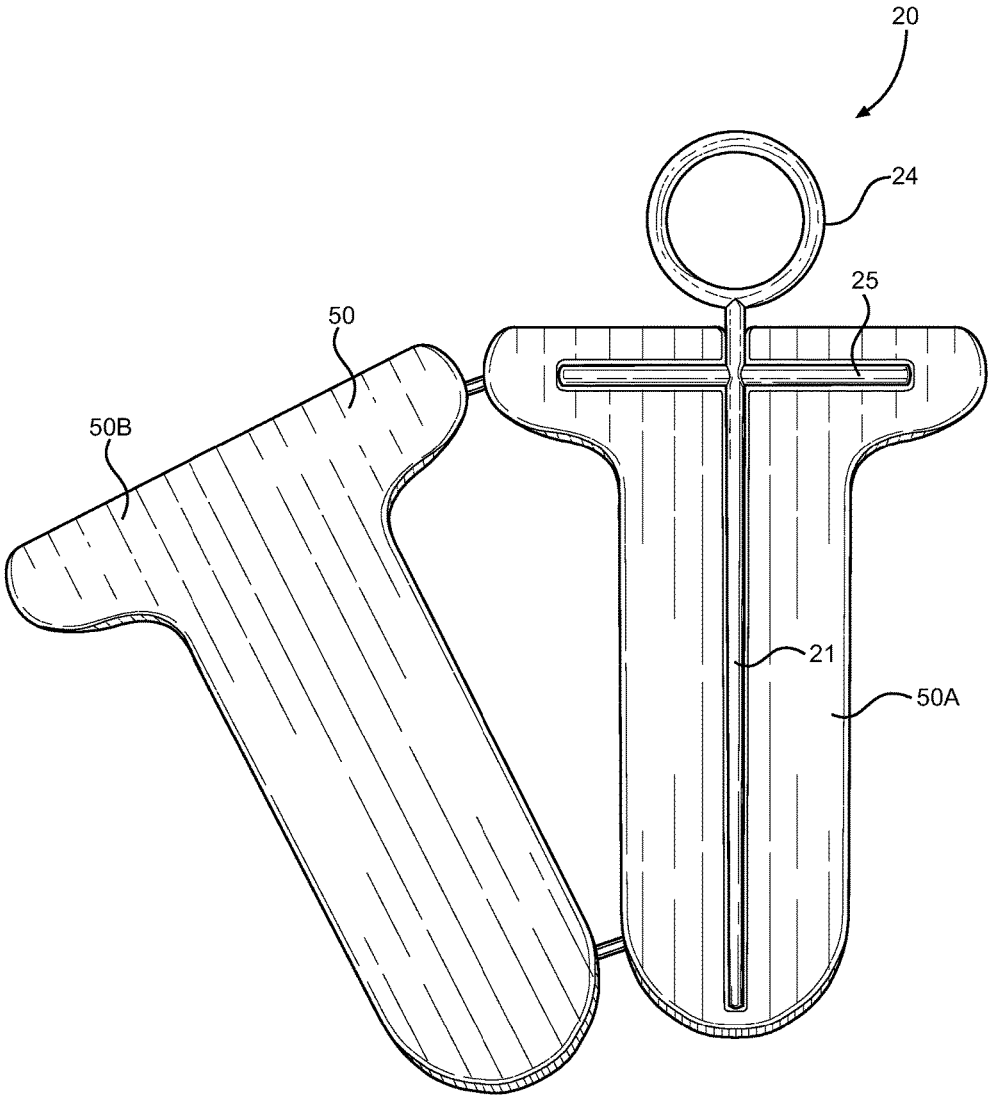
FIG. 2 shows an overhead perspective of the present invention as stored within a cover.

Referring now to FIG. 2, there is shown an overhead perspective of the scratching implement 20 removably secured to a cover 50. The scratching implement 20 includes a cover 50 that is configured to removably hold the scratching implement 20 for storage. The cover 50, as illustrated, is substantially T-shaped and includes a back portion 50A and a front portion 50B pivotally attached to one another via one or more hinges. The cover 50 includes an indentation 51 on the back portion 50A that is shaped similarly to the elongated shaft 21 and handle 25 of the scratching implement 20. Preferably, the indentation 51 is configured to removably secure the scratching implement 20 via friction fit, however other alternative means of securement are contemplated. The circular ring 24 of the scratching implement 20 extends beyond the cover 50 to allow for the circular ring 24 to be attached to a keychain or other support while the cover 50 is secured thereon. The cover 50 is particularly important because it protects users and other people within the general vicinity of injury from the pointed end, i.e., the second end 23, while not in use. The front portion 50B is considered to align with the back portion 50A to enclose the scratching implement 20 therein. The cover 50 also includes a fastener configured to removably secure the front portion 50B and the back portion 50A together to keep the cover in a closed configuration.

Figure 3:
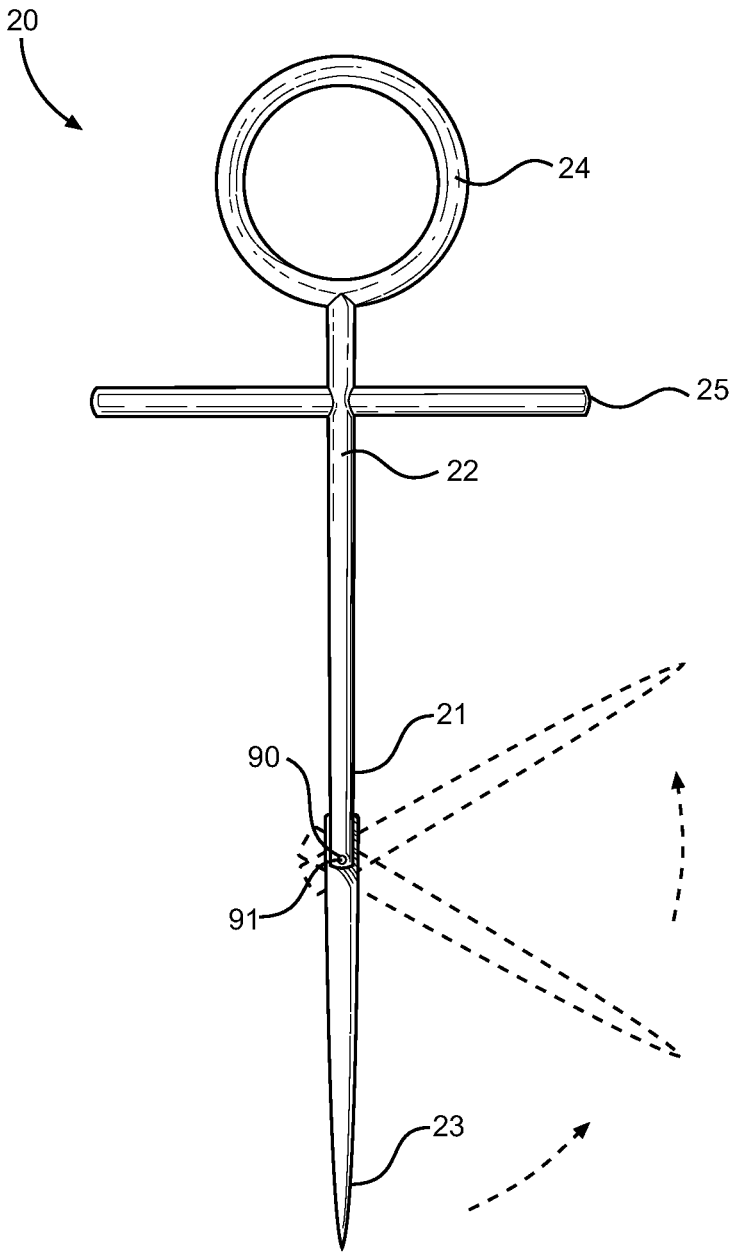
FIG. 3 shows an overhead perspective of an alternative embodiment of the present invention.

Referring now to FIG. 3, there is shown an alternative embodiment of the scratching implement. The scratching implement 20 includes an elongated shaft 21 having a first end 22 and a second end 23 substantially like the illustrated embodiment in FIG. 1. The elongated shaft 21 comprises a joint 91 that allows for the second end 23 to be actuated away or towards the first end 22 on a singular plane. The joint 91 is preferably located at a midpoint 90 of the elongated shaft 21. In a scratching configuration, the second end 23, i.e., the scratching end, is actuated away from the first end 22 via the joint 91 to form a straight shaft. In a stored configuration, the second end 23 is actuated towards the first end 22 via the joint 91. In some embodiments, the elongated shaft 21 includes a hollow region adapted to receive the second end 23 therein when the scratching implement 20 is arranged in a stored configuration. In this way, the user can store the scratching implement 20 when not in use.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scratching implement, comprising:

an elongated shaft having a first end and a second end such that the second end is more narrow than the first end;

a handle disposed towards said first end of said elongated shaft, the handle including a cylindrical crossbar transversely affixed across the elongated shaft;

a ring disposed on said first end distal to the handle, such that both the ring and the handle are configured to be cooperatively manipulated when maneuvering the elongated shaft; the ring being further adapted for use in securing said elongated shaft to a support surface or keyring;

said second end adapted for use in scratching a user's scalp;

further comprising a removable cover having an indentation thereon configured to receive and removably secure said elongated shaft and the cylindrical crossbar therein; and wherein said ring extends beyond said removable cover and is not removably secured within said indentation.

2. The scratching implement of claim 1, wherein said second end is pointed.

3. The scratching implement of claim 1, wherein said second is rounded.

4. The scratching implement of claim 1, wherein said indentation is configured to removably secure said elongated shaft and the cylindrical crossbar via a friction fit.

5. The scratching implement of claim 1, wherein said indentation is substantially T-shaped.

6. The scratching implement of claim 1, wherein said elongated shaft comprises a joint thereon that allows said second end to be rotated towards or away from said first end in a single plane.

7. The scratching implement of claim 1, wherein said ring includes a double loop configured to open and facilitate sliding of a key over the loops until fully inserted and secured to the ring.

8. The scratching implement of claim 1, wherein said ring is permanently attached to the furthermost point on the first end of the elongated shaft.

9. The scratching implement of claim 1, wherein the scratching implement is configured to scratch the user's scalp without disturbing the user's currently worn hairstyle.

10. A scratching implement, comprising:

an elongated shaft having a first end and a second end such that the second end is more narrow than the first end;

a handle disposed towards said first end of said elongated shaft, the handle including a cylindrical crossbar transversely affixed across the elongated shaft;

a ring disposed on said first end distal to the handle, such that both the ring and the handle are configured to be cooperatively manipulated when maneuvering the elongated shaft; the ring being further adapted for use in securing said elongated shaft to a support surface or keyring;

said second end adapted for use in scratching a user's scalp;

wherein said elongated shaft comprises a joint thereon that allows said second end to be rotated towards or away from said first end in a single plane.

* * * * *